US010052866B2

(12) United States Patent
Cooper et al.

(10) Patent No.: US 10,052,866 B2
(45) Date of Patent: Aug. 21, 2018

(54) PROCESS FOR PRINTING SECURE IMAGES

(71) Applicant: Esprix Technologies, LP., Sarasota, FL (US)

(72) Inventors: John Francis Cooper, Hendersonville, NC (US); Tonya Nicole Tremitiere, Sarasota, FL (US); Mark William Cummings, Lakewood Ranch, FL (US); Jana Petrova, Ellenton, FL (US); Jeff Lee Morgan, Sarasota, FL (US)

(73) Assignee: Esprix Technologies, LP, Sarasota, FL (US)

( * ) Notice: Subject to any disclaimer, the term of this patent is extended or adjusted under 35 U.S.C. 154(b) by 122 days.

(21) Appl. No.: 15/258,244

(22) Filed: Sep. 7, 2016

(65) Prior Publication Data

US 2017/0080704 A1 Mar. 23, 2017

Related U.S. Application Data

(60) Provisional application No. 62/284,150, filed on Sep. 21, 2015.

(51) Int. Cl.
*B41J 2/005* (2006.01)

(52) U.S. Cl.
CPC ..... *B41J 2/0057* (2013.01)

(58) Field of Classification Search
CPC ..... B41J 2/0057; C08G 65/48; B29C 67/00; C09D 171/00
See application file for complete search history.

(56) References Cited

U.S. PATENT DOCUMENTS

| | | | | |
|---|---|---|---|---|
| 2,495,286 | A | 1/1950 | Brubaker et al. | |
| 3,689,460 | A | 9/1972 | Nozaki | |
| 4,021,591 | A | 5/1977 | DeVries et al. | |
| 4,058,644 | A | 11/1977 | DeVries et al. | |
| 5,064,724 | A | 11/1991 | Ofstein | |
| 5,300,338 | A | 4/1994 | Byrd, Jr. et al. | |
| 5,597,389 | A | 1/1997 | Brown | |
| 5,837,375 | A * | 11/1998 | Brault ..... | B41M 5/0256 347/105 |
| 8,304,061 | B2 | 11/2012 | Feldman et al. | |

* cited by examiner

*Primary Examiner* — Thinh H Nguyen
(74) *Attorney, Agent, or Firm* — Dinsmore & Shohl LLP

(57) ABSTRACT

Polyketone based polymer sheets are employed in thermal dye transfer processes to produce permanent images. Also disclosed is the use of the process to produce identification cards, security cards and labels.

13 Claims, No Drawings

PROCESS FOR PRINTING SECURE IMAGES

CROSS-REFERENCE TO RELATED APPLICATIONS

This application claims priority of U.S. Provisional Application 62/284,150 filed on Sep. 21, 2015, the contents of which are incorporated herein by reference.

FIELD OF THE INVENTION

The invention relates to use of polyketone polymer sheets and thermal dye transfer processes to produce permanent images, particularly for such applications as ID or security cards.

BACKGROUND OF THE INVENTION

Custom printed plastic cards find use in a wide variety of applications such as patient ID, sports tickets, hotel keys, company or school ID, and the like. Such cards should provide high quality images as well as being easy to produce, flexible, durable, and low cost. In the case of identity cards there may be significantly greater requirements to prevent forgery or unauthorized use. These printed plastic cards should be tamper proof and provide additional levels of security such as UV or IR readable information, magnetic strips, 2D bar codes or RFID chips.

A number of techniques can be utilized to produce printed plastic cards or sheets.

For example, toner-based printers can easily print images on many types of plastics such as PVC, polyester, polycarbonate or polyketone, depending on the fusing temperature of a particular printer. However, typical toner-based images can easily be damaged by abrasion and can also be altered to produce a forged document. Likewise, inkjet or traditional offset printing techniques can provide acceptable printed images although these are also not durable or tamper-proof unless laminated which in itself provides a more complex solution. Thermal transfer printing is another technique that can be used to provide printed plastic images. In this case a polymer or wax layer is image-wise transferred from a release backing to the plastic. Such images are also not tamper-proof or abrasion resistant unless laminated or overcoated with a protective layer. In each of the above techniques a second overcoat or lamination step is required to achieve a level of permanence and tamper-resistance.

Another printing process for decorating plastic sheets is referred to as "dye-sublimation" where pre-coated dye layers on a backing layer are placed in contact with the receiver sheet and individual thermal heads used to image-wise transfer the dye only to the plastic. Actually, this process is not true dye sublimation which would mean the dyes transfer from a solid state to a gaseous state, without going through a liquid state. This dye ribbon process is more accurately referred to as dye diffusion as the molten dye diffuses into the substrate. Certain types of plastics such as polyester are receptive to these dyes. Other plastics such as polycarbonate require a separate dye receiver coating. Where the plastic sheet is receptive, the dye migrates into the sheet itself and provides both a level of abrasion and tamper resistance. If it is desired to add an additional security feature such as invisible UV readable information or a magnetic stripe, a separate coating on the dye-based ribbon would be required and that whole layer would transfer as with thermal ribbons. While this process offers an advantage in being a single step, there can be a significant cost for the coated ribbon as much of the dye in many of the color panels is typically not used.

While the current processes used for producing plastic ID cards may be suitable for many purposes, they also suffer from a number of disadvantages. The traditional PVC or polyester cards are not sufficiently durable enough or tamper-proof for many applications. The use of pre-coated dye ribbons also creates a significant amount of wasted dye in the portions of the ribbon not used. Also, certain dyes used in dye diffusion printers may not have adequate heat and light stability, particularly for outdoor exposure.

What is desired is a polymer sheet or film that overcomes difficulties with PVC, polycarbonate or polyester sheets.

Polyketone polymers are well known. U.S. Pat. No. 2,495,286 to Brubaker discloses polymers of carbon monoxide and ethylenic unsaturated monomers. U.S. Pat. No. 3,689,460 to Nozaki discloses a process of producing high molecular weight polyketone polymers using palladium catalysts. Extruded sheets of polycarbonate film are also well known as are co-extruded laminates of polycarbonate with a polymer such as polypropylene as disclosed by Ofstein in U.S. Pat. No. 5,064,724. Byrd in U.S. Pat. No. 5,300,338 also discloses coextruded laminates of polyketone with nylon, phenoxy or polyvinylidene polymers. Use of polycarbonate polymers in sublimation transfer sheets have also been disclosed as in U.S. Pat. Nos. 4,021,591 and 4,058,644 to DeVries. In this case the polyketone is of low molecular weight and is designed to be part of a coating solution that would be transferred to a substrate. Polyketone polymers have also been frequently referenced as a component of jet inks. Use of polyketone films have also been disclosed as a component of laminated security documents as in U.S. Pat. No. 8,304,061 where Feldman proposes using a polyketone sheet as part of a laminate core layer for laser imaging. It is also known that polyketone polymers can be infused with disperse dyes as shown in U.S. Pat. No. 5,597,389 to Brown. However, in no case are polyketone films or sheets used as a receptor layer that would be infused with solvent or sublimation dye by either conventional or digital printing processes.

SUMMARY OF THE INVENTION

The object of this invention is two-fold. The first is to provide a plastic sheet or ID card material that is capable of being imaged by a variety of techniques and yet meets the demanding physical challenges related to durability and tamper-resistance. The second object is to provide a plastic substrate that can be used in both dye diffusion and dye sublimation imaging and which overcomes the deficiencies of current plastic substrates in terms of permanency, cost, durability and ability to add additional security features.

The current invention relates to thermally infusing polyketone polymer film or sheets with solvent or disperse dyes by use of any one of a variety of traditional or digital printing techniques. In one variation of the process a traditional ink, jet ink or toner is formulated with a solvent or disperse dye that is capable of being activated by heat such as by diffusion or sublimation. The polyketone sheet is first printed with the ink or toner using any known conventional or digital printing process. The printed image may then be laminated with a protective layer or covered with a transparent, heat-resistant material such as glass and sufficient heat applied to cause the solvent or disperse dye to infuse the polyketone sheet.

A second variation of the process is to contact the polyketone sheet with a dye coated ribbon such as those used in commercial dye diffusion printers available from companies such as Zebra Technologies. Thermal print heads cause the dye to image-wise diffuse into the polyketone sheet, creating a durable ID card.

A third variation of the inventive process utilizes a sublimation dye-containing ink or toner image that is deposited onto a plain paper transfer sheet using any of the known techniques as mentioned above. That transfer sheet is then placed in contact with a sheet of polyketone and then enough heat is applied to transfer only the dye into the sheet. In particular it should be noted that the transferred dye image infuses the plastic body rather than remain on the surface. Thus it cannot be altered by solvents or abrasion, providing a very secure imaged sheet. Using a typical multi-color toner-based printer it is also possible to incorporate a security component in a toner and use an additional toner station to deposit that toner on the printed sheet. Certain of such security chemicals are also capable of migrating into the polyketone sheet to provide additional protection. Alternatively, during the production of the plastic sheet by extrusion process a security component could be incorporated into the body of the plastic sheet, providing a tamper-proof solution.

The invention is not limited to a specific grade or type of polyketone. Polyketone is a non-hazardous polymer prepared by polymerizing ethylene, propylene and carbon monoxide and could be even considered an environmentally friendly polymer. For plastic ID card applications it has many desirable properties such as low moisture pick-up, good flexural strength and modulus, good impact strength, high tear-resistance, dimensional stability and better solvent resistance than more traditional plastic ID card polymers. It is also significantly lower in density than competitive polyester or PVC sheets. Of importance for dye sublimation processes is its high melt flow temperature of 220° C. which is higher than many commercial plastic ID card plastics. An example of a polyketone polymer is Ketoprix™ from Esprix. The polymer is easily extruded into sheets of any desired thickness. It is also possible to modify a polyketone polymer with compounds to affect certain properties and such modified polyketones are included in this invention.

DETAILED DESCRIPTION OF THE INVENTION

To practice this invention a polyketone film or sheet of desired thickness is prepared by traditional extrusion process. This sheet may then be die cut to ID card dimensions or for other applications used in any size format that conforms to the desired printing process. For ID applications that use dye ribbons the polyketone cards would directly replace the more traditional PVC or polyester cards.

Plastic sheets may also be imaged by a two-step dye sublimation process. This technique utilizes existing toner or jet ink-based printers where the toner or jet ink is designed with heat activated solvent or disperse dyes in their composition. In each case a dye-bearing ink or toner image is printed onto an intermediate transfer paper. That paper is then placed in contact with the plastic sheet. Sufficient heat and pressure is then applied to the transfer sheet such that the dye is released from the toner or ink and infuses the substrate creating permanent durable and tamper-resistant images. While this process is more complex than dye-diffusion it has advantages in that it can use existing printers and the materials cost can be much less. This process is most suitable for substrates that are resistant to the transfer temperatures, typically in the range of 350-450° F., which eliminates many types of plastic sheet materials.

It is also possible to print solvent or sublimation dye-containing inks or toners directly onto a polyketone film or sheet and laminate a protective layer over the printed image. This laminate could be clear if the printed image is to be viewed from either side of the finished product or it could be a colored or white film if the printed image is to be viewed from the opposite side as the printed image.

EXAMPLES

1. Produce prints on the Oki C831, while utilizing sublimation dye toners. Allow manual flat heat press to acclimate to 400 degree Fahrenheit. Place M630A polyketone substrate (2"×3" in this case) on heat press silicon padded sample shelf. Place printed paper (20 lb. copy paper in this case) on polyketone substrate, and lower the heated platen and lock-in at moderate to high pressure. After 45 seconds release and raise heated platen, and immediately peel off paper. The resulting image was dense and sharp. Permanency of image was evaluated by cleaning polyketone substrate with isopropyl alcohol, acetone, MEK, toluene, and ethyl acetate. Density and sharpness of the image remained intact after all solvents and no evidence of removed dye was noticed on the cleaning towel.

2. Produce prints on the Oki C831, while utilizing sublimation dye toners. Allow manual flat heat press to acclimate to 375 degree Fahrenheit. Place M630A polyketone substrate (2"×3" in this case) on heat press silicon padded sample shelf. Place printed paper (20 lb. copy paper in this case) on polyketone substrate, and lower the heated platen and lock-in at moderate to high pressure. After 60 seconds release and raise heated platen, and immediately peel off paper. The resulting image was dense and sharp. Permanency of image was evaluated by cleaning polyketone substrate with isopropyl alcohol, acetone, MEK, toluene, and ethyl acetate. Density and sharpness of the image remained intact after all solvents and no evidence of removed dye was noticed on the cleaning towel.

The invention claimed is:

1. A printing process comprising:

contacting a film or sheet of polyketone polymer with a dye suitable for dye diffusion or dye sublimation thermal dye transfer processes; and infusing the dye into the film or sheet of polyketone polymer.

2. The process according to claim 1 whereby a pre-coated dye ribbon is placed in contact with the film or sheet of polyketone polymer and the step of contacting further comprises transferring the dye from the ribbon into to the polyketone film or sheet from thermal print heads.

3. The process according to claim 1 whereby a solvent or sublimation dye-containing toner is printed onto an intermediate receiver sheet using an electrophotographic techniques; and placing the printed receiver sheet in contact with the film or sheet of polyketone polymer and a heated source used to transfer the solvent or sublimation dye into the film or sheet of polyketone polymer.

4. The process according to claim 1 whereby a solvent or sublimation dye-containing inkjet ink is printed onto an intermediate receiver sheet by an inkjet printing processes; and placing the printed receiver sheet in contact with the polyketone film or sheet and a heated source to transfer the solvent or sublimation dye into the film or sheet of polyketone polymer.

5. The process according to claim 1 whereby a solvent or sublimation dye-containing printing ink is printed onto an intermediate receiver sheet using offset, screen or other non-digital printing process and then placing the printed receiver sheet in contact with the polyketone film or sheet and a heated source to transfer the solvent or sublimation dye into the film or sheet of polyketone polymer.

6. The process of claim 1, wherein the film or sheet of polyketone polymer consists of a polyketone polymer.

7. The process of claim 1 where the polyketone polymer is an aliphatic polyketone polymer.

8. A printing process comprising:

laminating a film or sheet of polyketone polymer with a second polymer or paper to form a polyketone laminate, the second polymer or paper capable of acting as a receiver sheet for a dye suitable for use in dye diffusion or dye sublimation thermal dye transfer processes.

9. The process according to claim 8 whereby a solvent or sublimation dye-containing toner is printed onto the intermediate receiver sheet using an electrophotographic technique and; and placing the printed receiver sheet in contact with the polyketone laminate and a heated source used to transfer the solvent or sublimation dye into the polyketone film or sheet.

10. The process according to claim 8 whereby a solvent or sublimation dye-containing inkjet ink is printed onto an intermediate receiver sheet by an inkjet printing processe; and placing the printed receiver sheet in contact with the polyketone laminate and a heated source to transfer the solvent or sublimation dye into the polyketone laminate.

11. The process according to claim 8 whereby a solvent or sublimation dye-containing printing ink is printed onto an intermediate receiver sheet using offset, screen or other printing process and then placing the printed receiver sheet in contact with the polyketone laminate and a heated source to transfer the solvent or sublimation dye into the polyketone laminate.

12. The process of claim 8, wherein the film or sheet of polyketone polymer consists of a polyketone polymer.

13. The process of claim 8 where the polyketone polymer is an aliphatic polyketone polymer.

* * * * *